United States Patent [19]

Davier

[11] Patent Number: 4,869,713

[45] Date of Patent: Sep. 26, 1989

[54] CENTRIFUGAL MACHINE WITH RETRACTABLE SUPPLY SPOUT

[75] Inventor: Jean-Pierre Davier, Lyon, France

[73] Assignee: Robatel S.L.P.I., Genas, France

[21] Appl. No.: 280,819

[22] Filed: Dec. 7, 1988

[30] Foreign Application Priority Data

Dec. 16, 1987 [FR] France ..... 87 17860

[51] Int. Cl.[4] ..... B04B 11/00

[52] U.S. Cl. ..... 494/62; 494/43

[58] Field of Search ..... 494/85, 62, 63, 60, 494/61, 82, 43, 22, 23, 25, 26, 27, 29, 30, 35, 37; 252/626

[56] References Cited

U.S. PATENT DOCUMENTS

| | | | |
|---|---|---|---|
| 1,927,822 | 9/1933 | Coe | 494/62 |
| 3,073,516 | 1/1963 | Glasson | 494/62 |
| 3,893,907 | 7/1975 | Caneuari | 494/27 |
| 4,406,651 | 9/1983 | Dudrey | 494/62 |

*Primary Examiner*—Robert W. Jenkins

*Attorney, Agent, or Firm*—Dowell & Dowell

[57] ABSTRACT

In order to dispense with any deformable protective bellows element in a centrifugal machine, the connection between the fixed supply pipe and the retractable pouring spout is disposed inside the containment envelope, while the spout with its support sleeve and its control mechanism are carried by a removable extraction stopper.

8 Claims, 4 Drawing Sheets

PRIOR ART 4
5
7
6
12
22
21
20
10
8b
19
8a
3
8
2
1
13

CENTRIFUGAL MACHINE WITH RETRACTABLE SUPPLY SPOUT

BACKGROUND OF THE INVENTION

1. Field of the Invention

The present invention relates to centrifugal machines and more particularly (since it is in that case that its application appears to present the greatest interest), but not exclusively, to centrifuging machines of the pendulum type intended for the reprocessing of radio-active materials.

2. History of the Related Art

As illustrated in FIG. 1 of the accompanying drawings, such a machine generally comprises a lower bowl 1 which is disposed inside a fixed containment envelope or housing 2 and which is secured to the base of a vertical shaft 3 driven in rotation by a motor 4 with the interposition of a pivot system 5 which allows the assembly to be oriented freely under the effect of the unbalances created by the high-speed rotation of the bowl 1. In order to allow extraction of the rotating assembly for operations of maintenance, repair or replacement, the shaft 3 passes through the protective slab or shield 6 which supports the fixed envelope 2 through a removable stopper 7 which is itself secured to an inner tank 8 for supplying the rotating bowl 1.

In the conventional art, the laden liquid is poured into the tank 8 via a pouring spout 9 mounted to slide telescopically on the end of the supply pipe 10. Axial displacement of the spout 9 under the effect of a control mechanism 11 supported either by the slab 6 or by a removable stopper 12 engaged in a vertical housing or opening therein, makes it possible in one direction to bring the free end of the spout 9 above the interior of the tank 8, avoiding any risk of untimely flow of the laden liquid in the lower part of the envelope 2 at the level of which the purified liquid is collected and evacuated (pipe referenced 13), while the slide of this spout 9 in the opposite direction allows withdrawal of the spout 9 upwardly with the assembly supported by the removable stopper 7.

When the laden liquid to be processed is radioactive or otherwise dangerous, it is essential to avoid any risk of leakage of liquid, gaseous release or of radiations at the level of the connection between the retractable spout 9 and the end of the pipe 10. To that end, a deformable metal bellows element 14 is generally employed which ensures containment of the connection without hindering axial sliding of the spout 9.

Now, in practice, production of this bellows element 14 raises problems which are difficult to solve. If its thickness is too small, it may be damaged very rapidly by mechanical shock or by corrosion, in that case creating the leakages which is to be avoided, while, if this thickness is provided to be sufficiently large to set aside such a drawback, it becomes difficult to manoeuvre the control mechanism 11 associated with the spout 9. This leads to risks of errors of positioning of the spout or to failures. A compromise must therefore be adopted which does not satisfy either one or the other of the two imperatives.

It is an object of the present invention to solve the problem by purely and simply eliminating the protective metal bellows element conventionally associated with the pouring spout.

SUMMARY OF THE INVENTION

According to the invention, the retractable spout is mounted to slide axially in a sleeve carried inside the fixed containment envelope by a vertical wall secured to the removable stopper traversed by the shaft for driving the bowl. The displacement of this spout in one direction or the other under the action of its control mechanism suspended from the stopper having for its effect either to engage its upstream end on the opening of the supply pipe in the fixed envelope to pour into in the bowl laden liquid to be processed, or to disengage the end from this opening in order to allow extraction of the stopper and of the rotating assembly of the machine.

It will be readily appreciated that the connection of the pouring spout and of the end of the supply pipe is thus effected within the fixed envelope, thus dispensing with any deformable protecting bellows.

BRIEF DESCRIPTION OF THE DRAWINGS

The invention will be more readily understood on reading the following description with reference to the accompanying drawings, in which.

As indicated in the preamble, FIG. 1 schematically illustrates the general arrangement of a centrifugal machine of conventional type.

DETAILED DESCRIPTION OF THE DRAWINGS

Figure 1:
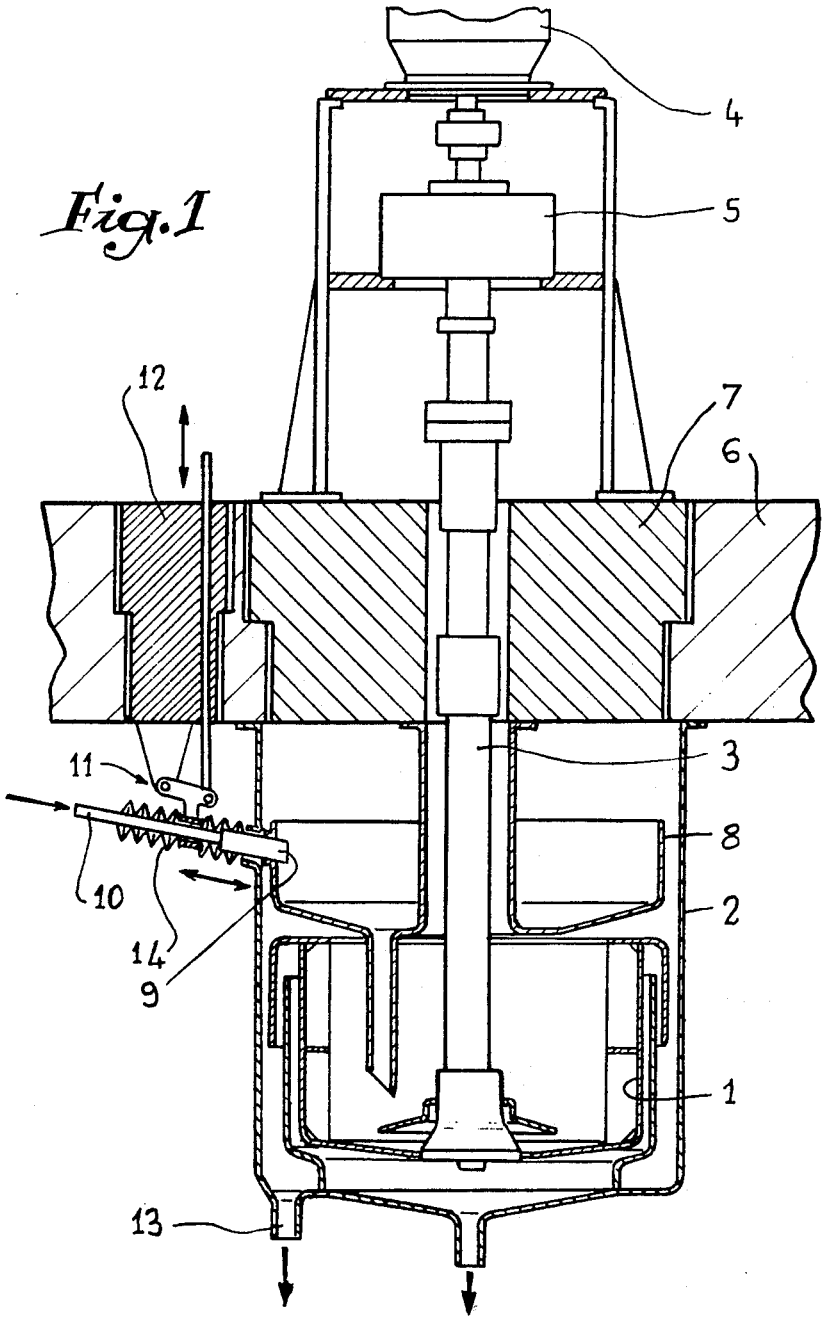
Figure 2:
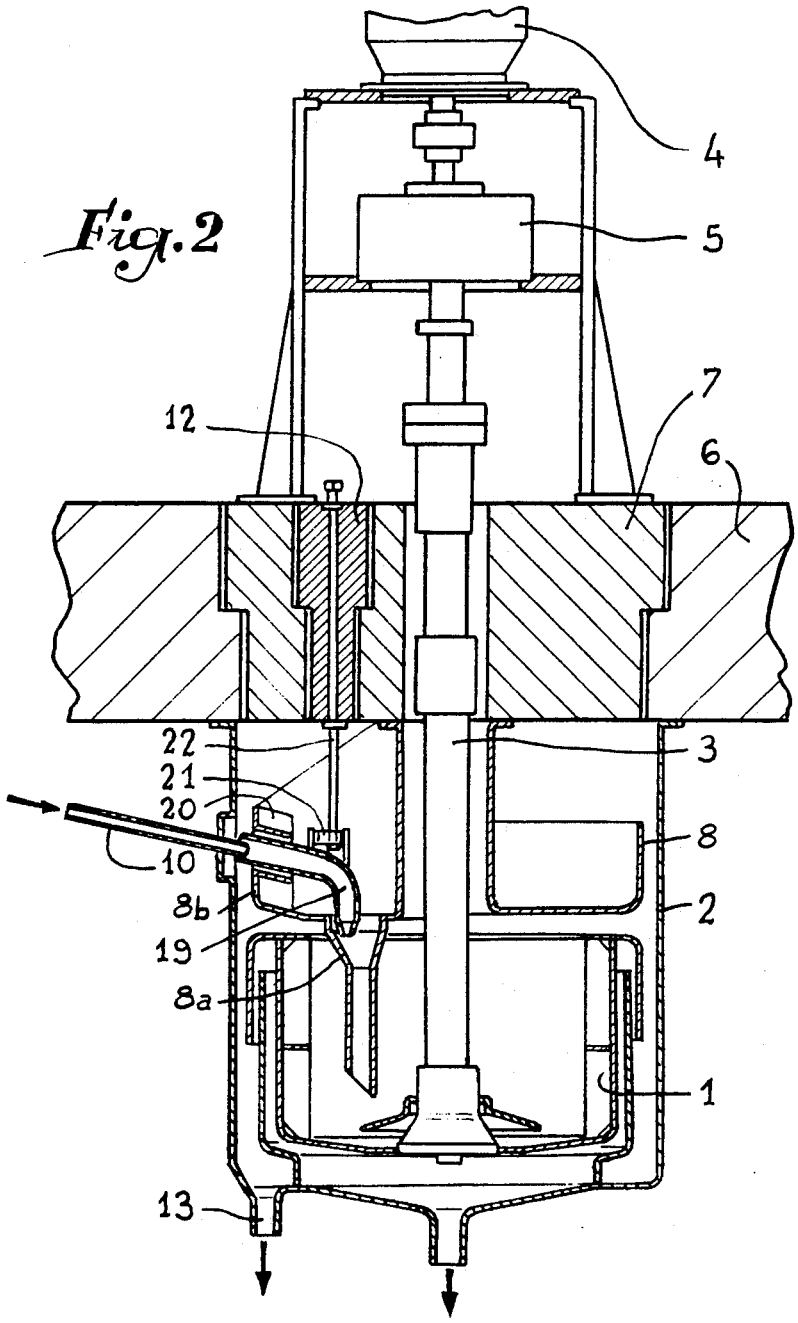
FIG. 2 schematically shows the arrangement of a centrifugal machine according to the invention.

Referring again to the drawings, FIG. 2 employs the same references as FIG. 1 to designate identical parts, including the supply pipe 10 for conveying laden liquid into the rotating bowl 1 via the inner tank 8 suspended from the removable stopper 7. However, it will be observed that this pipe 10 hermetically traverses the lateral wall of the fixed envelope 2 so that its opening is disposed inside the latter, thus being perfectly protected.

Figure 3:
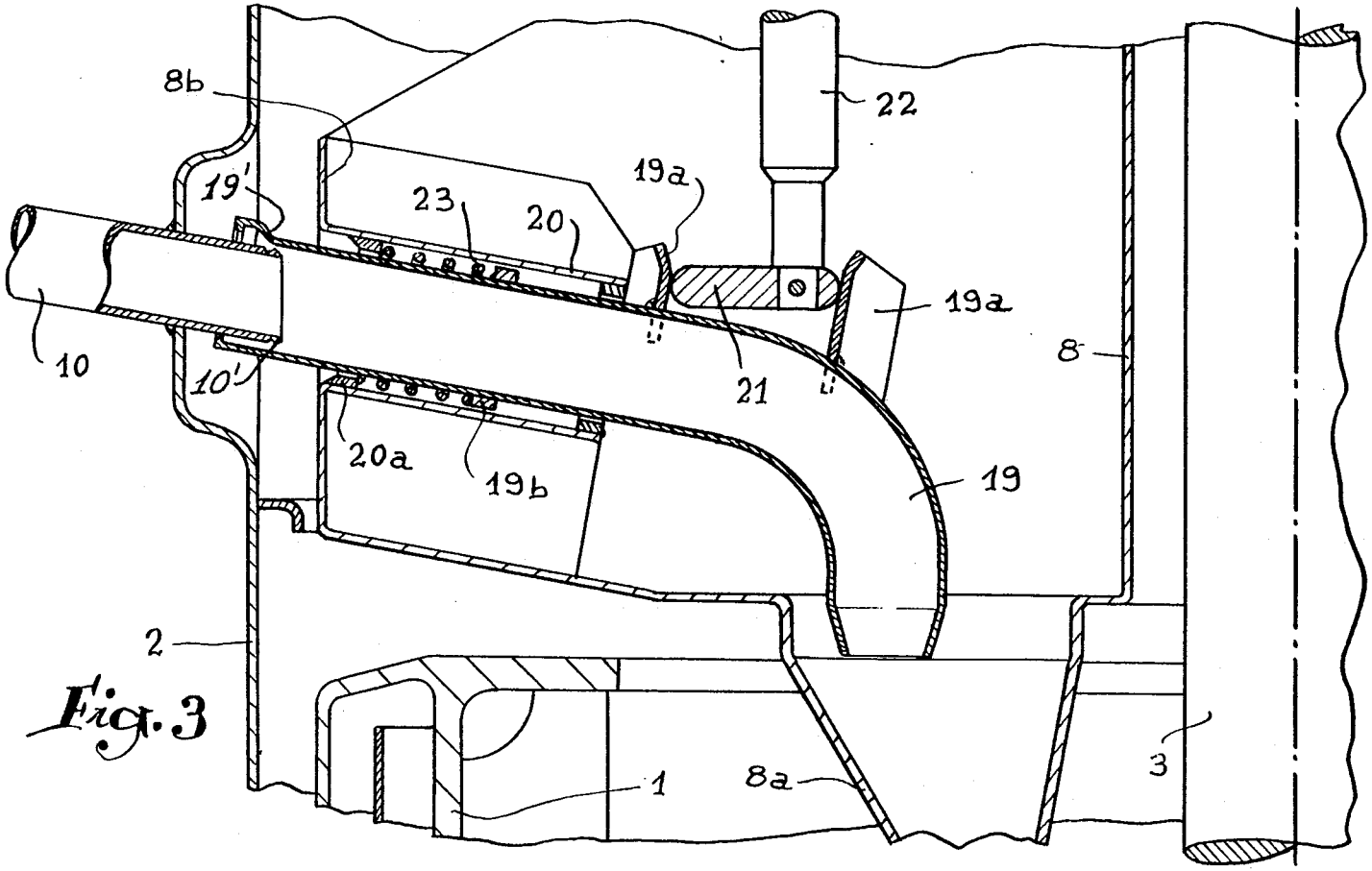
FIGS. 3 and 4 are axial sections on a larger scale showing the retractable pouring spout in the two positions of use.

As shown more particularly in FIG. 3, there is engaged on the opening or discharged in 10' of the pipe 10 a slideable spout 19 which is, advantageously provided to be bulging or enlarged at its receiving or upstream end 19' in order to recover any accidental overflow. The spout is assumed to have a bent profile in order to penetrate by its downstream end in the widened top of the vertical pipe 8*a* of the inner tank 8. This spout 19 is guided axially inside an oblique sleeve 20 secured to the lateral wall 8*b* of the tank 8, and in addition it is secured to two vertical fins or flanges 19*a* which project upwardly in order to form bearing surfaces for an eccentric 21. The eccentric is fitted on the base of the rotating shaft 22 for manoeuvring the control mechanism which, in FIG. 2, has been assumed, as in the prior art, to be carried by an independent stopper 12, it being, however, observed that, in the case of FIG. 2, this stopper 12 is no longer housed in the slab 6 as in FIG. 1, but in the removable stopper 7.

In the position illustrated in FIG. 3, the laden liquid which circulates in the pipe 10 is collected by the pouring spout 19 which conveys it into pipe 8*a* of the inner tank 8. Continuity between the pipe 10 and the spout 19 is ensured, avoiding any risk of untimely flow and without it being necessary to provide a protecting bellows element since such protection is ensured by the containment envelope 2 itself.

Figure 4:
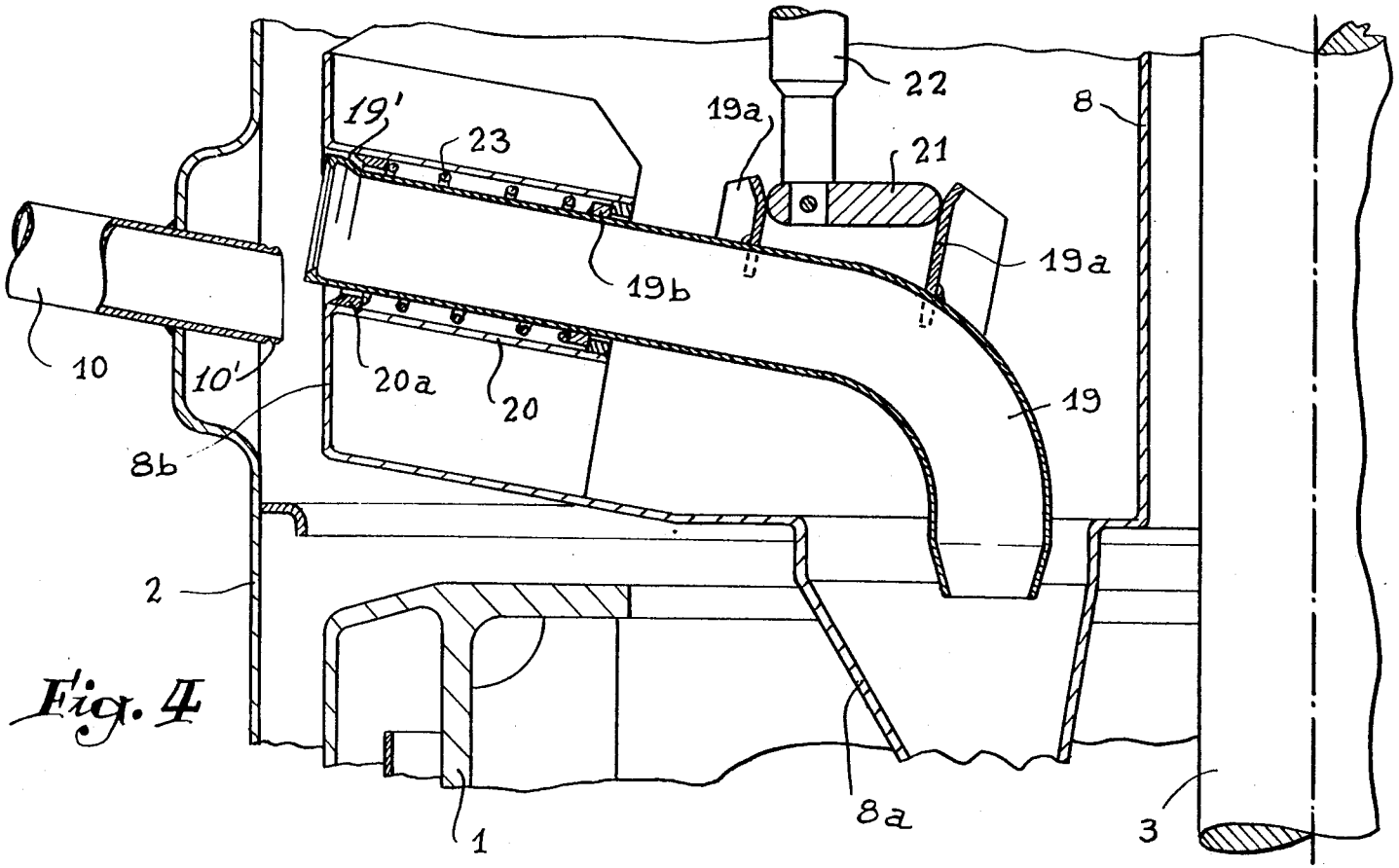

On the contrary, in FIG. 4, it has been assumed that the shaft 22 has been manoeuvred angularly through 180+, so that, under the effect of the eccentric 21, the pouring spout 19 has moved axially in the direction of the shaft 3. The upstream end 19' of the spout 19 is then disengaged from the opening of pipe 10, so that this spout 19 no longer opposes extraction of the inner tank 8 and of the assembly carried by the removable stopper 7.

In order to avoid any risk of false or accidental manoeuvre, it may be advantageous to provide the pouring spout 19 with a system for elastic return to the disengaged position of FIG. 4. This system may comprise, in particular, a spring 23 interposed between an outer flange **19*b* of the spout 19 and an inner flange 20*a* of the sleeve 20**.

It goes without saying that the invention is applicable to centrifugal machines in which the inner supply tank 8 is replaced by a vessel forming core in order to limit the volume of liquid capable of accumulating in the envelope 2 in the event of untimely blockage.

It must, moreover, be understood that the foregoing description has been given only by way of example and that it in no way limits the domain of the invention which would not be exceeded by replacing the details of execution described by any other equivalents.

What is claimed is:

1. In a centrifugal machine, particularly of the pendulum type for the reprocessing of a radioactive material, in which a rotating assembly is provided which includes a bowl supported with a device for rotating the bowl and which rotating assembly is carried by a stopper removably housed in a protective slab which supports a fixed containment envelope which contains the bowl, and wherein supply to the bowl of a laden liquid to be treated is effected by way of a supply conduit and a pouring spout which is retractable from the supply conduit in order to allow extraction of the stopper and the rotating assembly from the containment envelope the improvement comprising, the supply conduit having a discharge end extending into the containment envelope and being of a first diameter, said spout having an upstream end having a second diameter, a sleeve mounted inside the fixed containment envelope by a vertical wall which is secured to the removeable stopper, the spout being axially slideable within said sleeve so as to be moveable from a first position wherein said upstream end thereof is adjacent the supply conduit in order to receive laden liquid therefrom to a second position in which said upstream end of the spout is in spaced relationship with the supply conduit and within said containment envelope, a control mechanism carried by the stopper, engaging means for engaging said control mechanism to the spout, said engaging means being operable by said control mechanism to move the spout from said first to said second position whereby when the spout is in said second position the stopper and the rotating assembly may be removed from the containment envelope.

2. The centrifugal machine of claim 1 wherein a pair of flange means are secured to the spout, said engaging means including an eccentric mounted to a rotating shaft carried by said control mechanism, said eccentric being engageable between said pair of flange means whereby upon rotation of said eccentric, the spout is caused to move axially from said first to said second position.

3. The centrifugal machine of claim 2 wherein said second diameter is greater than said first diameter whereby when the spout is in said first position, said upstream end thereof encircles the supply conduit.

4. The centrifugal machine of claim 3 including resilient means for normally urging the spout to said second position.

5. The centrifugal machine of claim 4 including a first flange secured to the spout and a second flange secured to said sleeve, said resilient means including spring means disposed about the spout and between said first and second flanges.

6. The centrifugal machine of claim 1 including resilient means for normally urging the spout to said second position.

7. The centrifugal machine of claim 6 wherein said second diameter is greater than said first diameter whereby when the spout is in said first position, said upstream end thereof encircles the supply conduit.

8. The centrifugal machine of claim 7 including a first flange secured to the spout and a second flange secured to said sleeve, said resilient means including spring means disposed about the spout and between said first and second flanges.

* * * * *